US005803243A

United States Patent [19]

Nestor et al.

[11] Patent Number: 5,803,243

[45] Date of Patent: Sep. 8, 1998

[54] LATCHING ROCKER SWITCH

[75] Inventors: James Michael Nestor, Niles; Samuel Edward Penn, Cortland, both of Ohio

[73] Assignee: General Motors Corporation, Detroit, Mich.

[21] Appl. No.: 900,670

[22] Filed: Jul. 25, 1997

[51] Int. Cl.[6] ..... H01H 3/20

[52] U.S. Cl. ..... 200/556; 200/553

[58] Field of Search ..... 200/556, 553, 200/557, 561, 339, 512

[56] References Cited

U.S. PATENT DOCUMENTS

| | | | |
|---|---|---|---|
| 3,519,775 | 7/1970 | Weremey | 200/556 |
| 3,591,747 | 7/1971 | Dennison | 200/153 |
| 5,446,253 | 8/1995 | Oshgan | 200/556 |
| 5,559,311 | 9/1996 | Gorbatoff | 200/513 |
| 5,622,254 | 4/1997 | Lee | 200/557 |

*Primary Examiner*—David J. Walczak
*Attorney, Agent, or Firm*—Cary W. Brooks

[57] ABSTRACT

A switch combines the benefit of the audible sound produced by ball and spring and metallic contact switches, with the simple, inexpensive, easy to assemble nonmetallic collapsible dome switches. A keycap with an audible lock arm having a ridge thereof for engaging at least one nub formed on the housing is provided allowing the keycap to be moved to at least a first and second position and locked. As the keycap is moved, the ridge moves over the nub producing an audible sound. Inexpensive and easy to assemble collapsible dome structures with electrically conductive pellets carried on an underside are used to close circuits on an underlying substrate.

19 Claims, 3 Drawing Sheets

LATCHING ROCKER SWITCH

TECHNICAL FIELD

This invention relates to electrical switches, and more particularly to electrical switches that latch or lock in position, and have collapsible domes.

BACKGROUND OF THE INVENTION

Many of the prior art latch switches use a spring and metal ball method to latch the switch between two different positions. These systems include numerous parts and are difficult to construct and assembly thus making them costly. Further, spring and metal ball switches have a tactile feel which is inconsistent and often relatively poor. For high current applications, greater than one amp, these switches utilized metal contracts. The ball and spring and metal contacts produced an audible clicking sound when the switch was depressed. In some cases this audible sound is a desirable feature. The audible clicking sound lets the operator, such as a truck driver, know the switch had been engaged.

An improved tactile feel is obtained utilizing switches having collapsible domes made from an elastomer material such as a silicone material. The collapsible dome is a simple one piece structure which is very inexpensive and easily assembled. However, the dome is very quiet during operation. The collapsible dome includes an electrically conductive pellet on the other side of the dome utilize to engage two spaced apart electrical traces closing a circuit. However, the conductive pellet is usually limited to low current applications of about 0.5 amp or less.

The present invention provides alternatives to and advantages over the prior art.

SUMMARY OF THE INVENTION

A keycap with an audible lock arm having a ridge thereon for engaging at least one nub formed on the housing is provided allowing the keycap to be moved to at least a first and second position and locked. As the keycap is moved, the ridge moves over the nub producing an audible sound. Inexpensive and easy to assemble collapsible dome structures with electrically conductive pellets carried on an underside are used to close circuits on an underlying substrate.

In another embodiment of the invention, a keycap preferably with first and second ends and opposed sides is pivotally connected to a housing. A collapsible dome is provided under each of the first and second ends of the keycap to selectively close a circuit underneath the dome as the keycap is pivoted. A flexible, audible lock arm extends from the keycap and includes a wedge shaped ridge on an outer surface of the arm. Three spaced apart grooves are formed in a planar surface of the housing. First and second spaced apart nubs are defined in the housing, each separating adjacent grooves. In a first position, the keycap has a first end pivoted downward and the ridge on the audible lock arm is received in a first groove along the outer side of a first nub. In is first position, a dome positioned under the first end of the switch is collapsed closing a circuit. As the second end of the keycap is slightly depressed by an operator, the ridge on the audible lock arm moves past the first nub producing an audible sound and the ridge comes to rest in a second groove formed between a first and second nubs. In this second position (rest position) neither of the domes is collapsed. The keycap is then movable to a third position wherein the ridge moves pass the second nub producing an audible sound and the ridge comes to rest in the third groove. In this third position, the second dome is collapsed by the second end of the keycap. The present invention combines the benefit of the audible sound produced by ball and spring and metallic contact switches, with the simple, inexpensive, easy to assemble nonmetallic collapsible dome switches.

In another embodiment of the invention, a keycap switch is provided having an elongated lock arm extending from a middle portion of the keycap. A ridge is provided on the outer surface of the lock arm for selectively locking the keycap in at least a first and second, and preferably third position. A first nub, and preferably a second nub, is provided on the housing. In a first position of the keycap, the ridge is on a first side of the first nub. The keycap is movable to a second position wherein the ridge moves pass the nub to a second side of the first nub and so that the ridge is between the two nubs. The keycap may be moved to a third position in which the ridge moves past the second nub.

These and other objects, features and advantages of the present invention will be apparent from the following brief description of the drawings, detailed description, and appended claims and drawings.

DESCRIPTION OF THE PREFERRED EMBODIMENT

Figure 1:
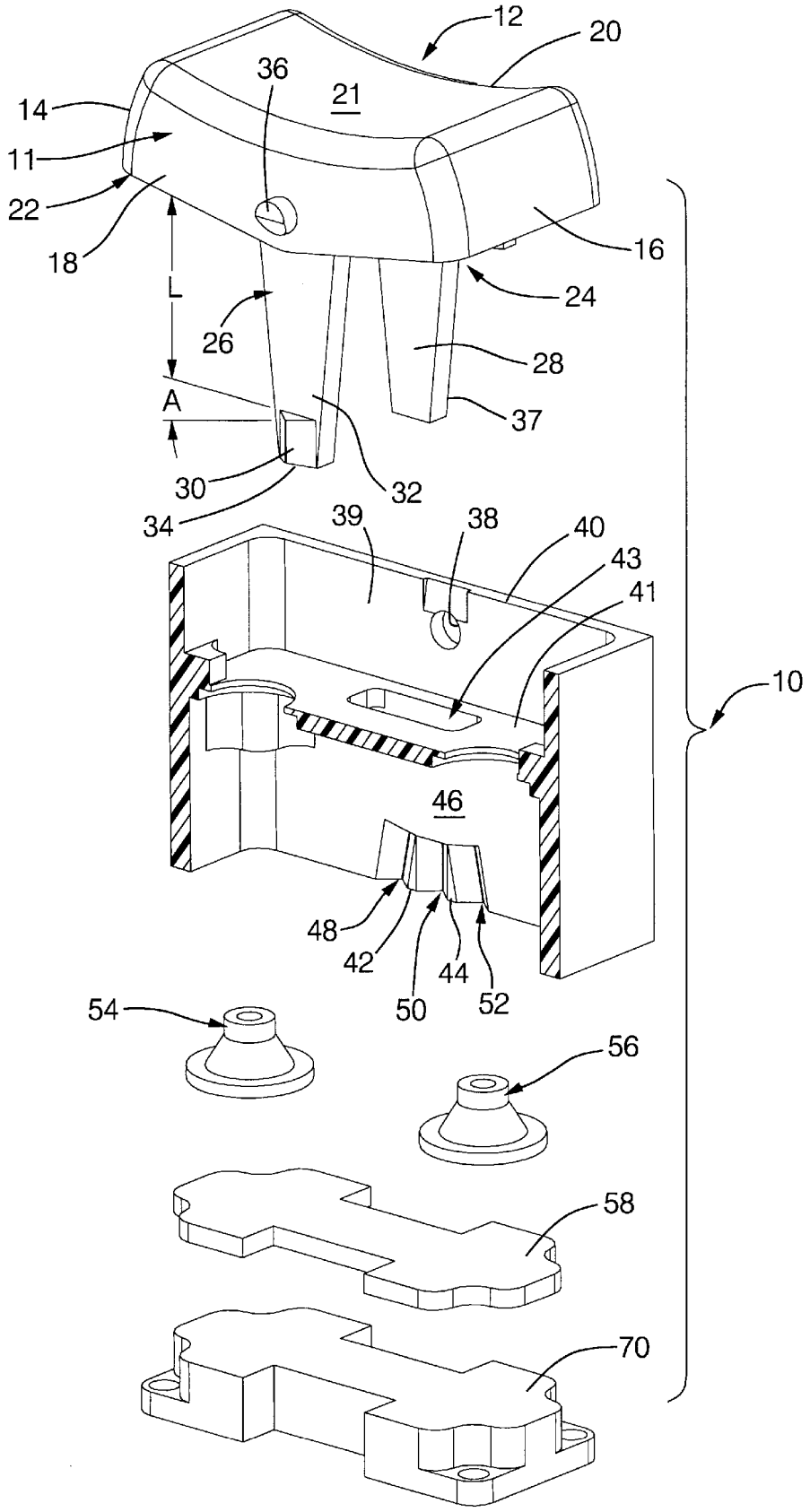
FIG. 1 is an exploded view, with portions broken away, of a switch according to the present invention.

FIG. 1 illustrates a switch 10 according to the present invention including a keycap 12. The keycap 12 may have an elongated body portion 11 including a first and second end 14, 16 and two opposed sides 18, 20 and a top surface 21. Alternatively the keycap 12 may be of the pedestal type known to those skilled in the switch art. A dome engagement surface 22, 24 is provided on an underside of the keycap near each of the keycap ends 14, 16. An audible lock arm 26,28 extends downwardly from the body portion, preferably from one of the sides 18, 20. A ridge 30, preferably wedge shaped, is positioned on an outer surface 32 and near the a free end 34 of the audible lock arm. Pivot rods 36 extend outwardly from the body portion 11 to be received in a recess or hole 38 extending through a housing 40 to facilitate pivotal movement of the keycap 12. The housing 40 includes a first and second nub 42, 44 formed in a face 46 of the housing and configured to follow the arcuate shape path of the ridge 30 on the audible lock arm. Preferably the first and second nub 42, 44 are formed by three adjacent wedge shaped grooves 48, 50, 52 in a face 46 of the housing separated by generally wedge shaped ridges defining the first and second nub 42, 44. The wedge shaped grooves 48, 50, 52 are designed to receive the wedge shaped ridge 30 on the audible lock arm. The audible lock arm 26 has sufficient flexibility to deflect inwardly toward the longitudinal axis of the keycap 12 to allow the ridge 30 to move past the nub 42, 44 as the keycap is pivoted. A lock arm stabilizer 41 may be provide extending from an inside wall 39 of the housing and having a slot 43 formed therein for receiving the audible lock arm 26, 28 and controlling and limiting the movement thereof.

The terms ridge and nub, as used herein, include structures having an engagement edge such as a projection extending from a surface, including ridges, nubs, ribs, lips, bumps, and the like, as well as engagement edges defining grooves or depressions formed in a substantially planar surface. Further, the term ridge may include an edge of a structure such as an edge 37 of the arm 26 extending from the body of the keycap.

Figure 4:
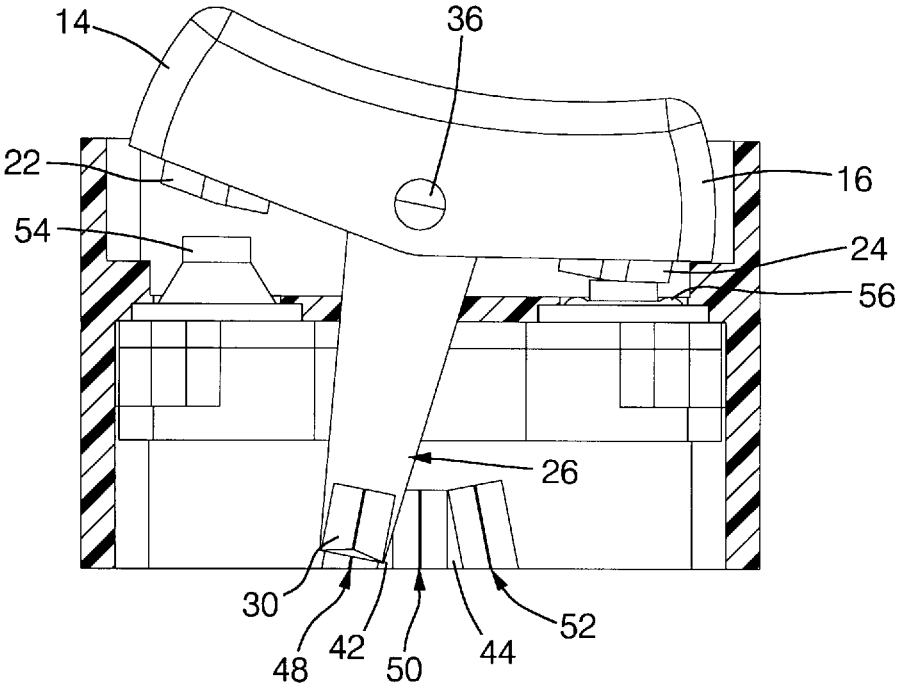
FIG. 4 is a sectional view of a switch according to the present invention in a third position.
Figure 5:
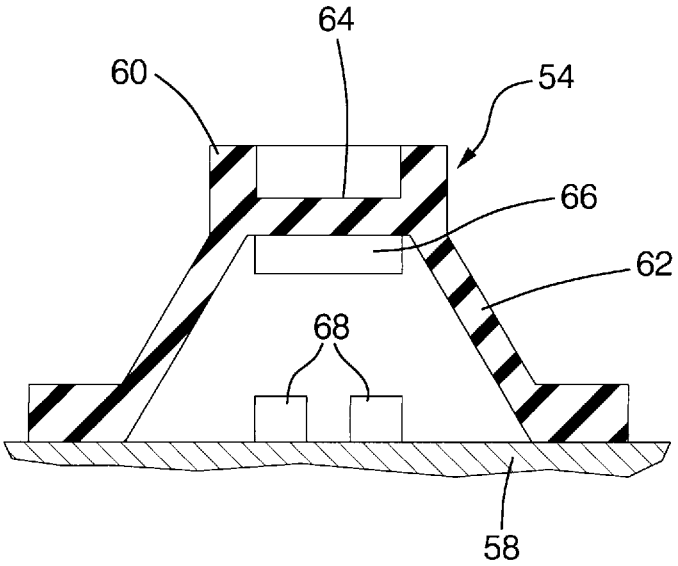
FIG. 5 is an enlarged sectional view of a collapsible dome useful in the present invention.

Referring to FIGS. 1 and 5, a collapsible dome 54, 56 is provided for each of the dome engagement surfaces 22, 24 (best shown in FIGS. 2–4) under the keycap 12 and positioned for engagement therewith. The collapsible dome 54, 56 is a nonmetallic, flexible polymeric material, preferably an elastomeric material such as a silicone based material. The collapsible dome 54, 56 is flexible enough to be collapsed by the keycap when an operator pushes down on the top of the keycap near one of the ends 14, 16. The collapsible dome 54, 56 is mounted on a stationary support 58 or circuit substrate such as a printed circuit board, or a flexible circuit having a flexible layer of polyimide. The collapsible dome 54, 56 may have a variety of configurations but preferably has a resilient, annular outer ring 60 of a given thickness, and downwardly extending flexible side wall 62 (FIG. 5) A thinner membrane 64 underlies the annular ring 60 and an electrically conductive pellet 66 is carried on the underside thereof. Two spaced apart electrical contacts 68 or electrical traces are provided on the substrate 58 underneath the electrically conductive pellet 66 so that upon collapse of the dome 54, 56, the electrically conductive pellet 66 engages the spaced apart traces 68 and closes a circuit on the substrate. The electrical conductive pellet is designed to carry 1 amp or less, preferably 0.5 amp or less. A back cover 70 may be provided for supporting the printed circuit board or flexible circuit substrate 58.

Figure 2:
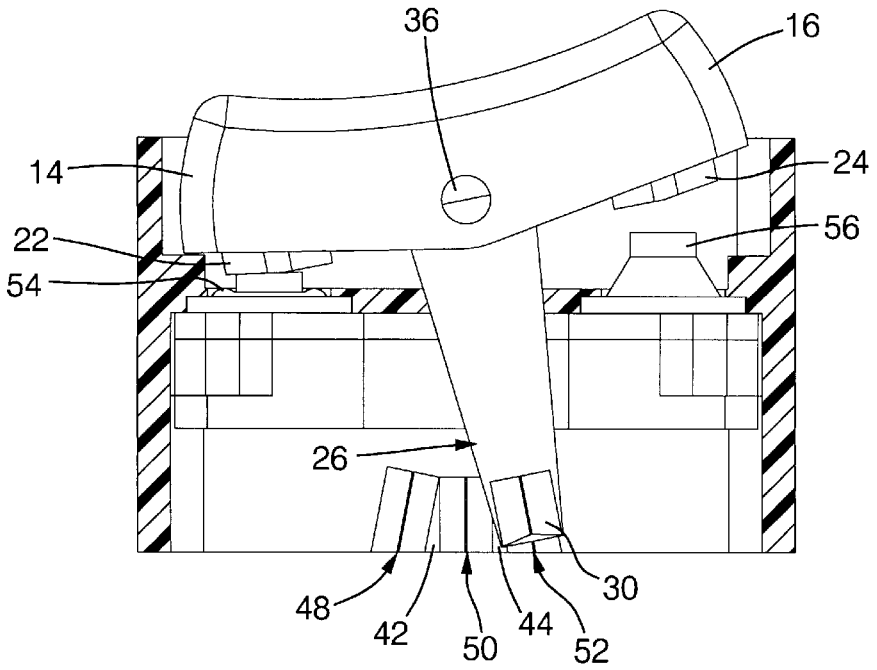
FIG. 2 is a sectional view of a switch according to the present invention in a first position.
Figure 3:
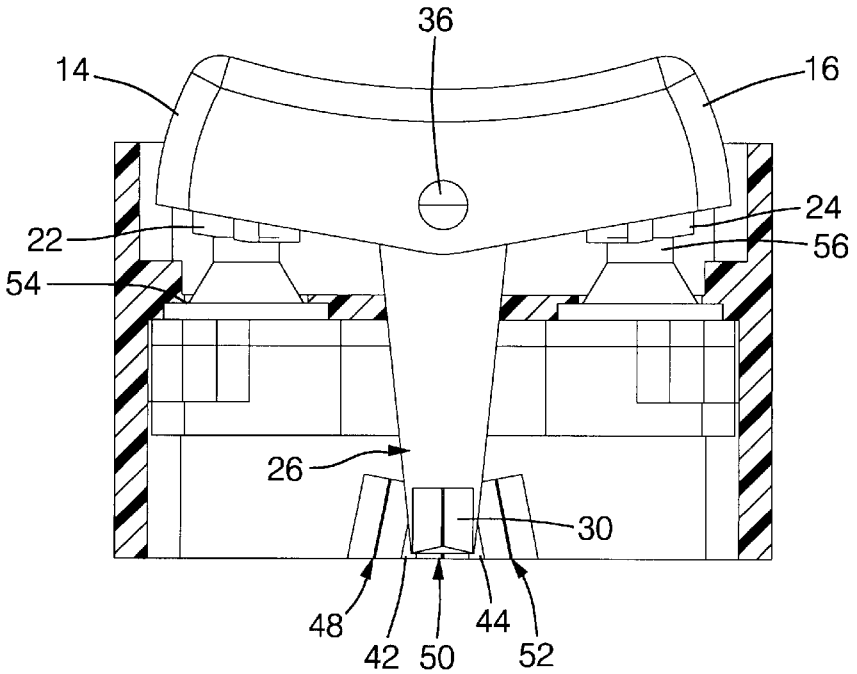
FIG. 3 is a sectional view of a switch according to the present invention in a second position.

As can be seen from FIGS. 2–4, the keycap is movable to a first position (FIG. 2) wherein a first end 14 of the elongated body portion is pivoted downward and the engagement surface 22 on the underside of the elongated body portion collapses the first dome 54 so that the electrically conductive pellet engages the two spaced apart traces 68 underneath the dome and closing the circuit on the substrate. The audible lock arm 26 is in a first position wherein the ridge 30 is on a first side of the first nub 44 formed in the housing and received in a first groove 52 locking the keycap 12 in the first position. The keycap 12 is movable to a second position (FIG. 3) wherein the audible lock arm deflects to allow the ridge 30 to moved past the first nub 44 making an audible sound. The ridge 30 comes to rest in a second groove 50 formed in the housing. In this second position, neither of the first and second ends 14, 16 of the elongated body portion have collapsed the associated dome 54, 56. The keycap 12 is then movable to a third position (FIG. 4) wherein the second end 16 of the keycap is depressed so that the audible lock arm ridge 30 is moved past a second housing nub 42 making a audible sound and the ridge 30 comes to rest in a third groove 48 formed in the housing locking the keycap 12 in the third position. In this third position, the second end 16 of the elongated body portion has collapsed the second dome 56 closing an associated circuit.

We claim:

1. A switch comprising:

a keycap, a housing, a substrate, and a first collapsible dome, the keycap being pivotally connected to the housing, the keycap having a body portion and at least a first audible lock arm extending from the body portion, the first audible lock arm having a first ridge, the substrate having at least a portion underlying the keycap and having at least a first pair of spaced apart electrical traces formed on a surface of the substrate, the first collapsible dome overlying the first pair of spaced apart electrical traces and having a conductive element on the underside of the dome positioned to engage the spaced apart electrical traces upon collapse of the first dome, a nub set for the first audible lock arm comprising at least a first nub formed in the housing and positioned to selectively be engaged by the first ridge, the keycap being movable to a first position in which the body collapses the dome and wherein the first ridge on a first side of the first nub locking the keycap in the first position, and the keycap being movable to a second position so that the first dome is fully extended opening the associated circuit and the first ridge is on a second side of the first nub locking the keycap in a second position, and so that upon movement of the keycap from the first position to the second position, the first ridge engages and slides over the first nub to produce an operator audible sound.

2. A switch as set forth in claim 1 wherein the keycap comprises an elongated body portion having two opposed sides, wherein the first arm extends downwardly from a first side of the body portion, and further comprising a second arm extending downwardly from a second side of the body portion.

3. A switch as set forth in claim 1, wherein each nub set further comprises a second nub, and wherein the keycap is movable from the second position to a third position wherein the ridge is on an outer the second nub.

4. A switch as set forth in claim 3 wherein the ridge and nubs are wedge shaped.

5. A switch as set forth in claim 3 wherein the housing includes a substantially planar surface having a first, second and third groove formed therein and wherein the first and second nub each separate adjacent grooves.

6. A switch as set forth in claim 3 wherein the ridge is wedge shaped and the housing includes a substantially planar surface having a first, second and third wedge shaped groove formed therein and the first and second nub each separated adjacent grooves.

7. A switch as set forth in claim 1 wherein the ridge and the nubs are wedge shaped.

8. A switch as set forth in claim 1 wherein the compressible dome comprises an elastomeric material.

9. A switch as set forth in claim 8 wherein the elastomeric material comprises a silicone.

10. A switch as set forth in claim 1 wherein the spaced apart electrical traces are constructed and arrange to carry about 1 amp or less.

11. A switch as set forth in claim 1 wherein said housing includes a substantially planar surface having a first and second groove defined therein and wherein the first nub separates the first and second groove.

12. A switch comprising:

an elongated keycap, a housing, a substrate, and a first and second collapsible dome, the keycap having first and second opposed ends and a middle portion there between, the keycap being pivotally connected at the middle portion to the housing and having a first audible lock arm extending from the middle portion and having a first ridge, the substrate having at least a portion underlined the keycap, each of the collapsible domes overlying a pair of spaced apart electrical traces formed on the surface of the substrate, each of the collapsible domes having an electrically conductive element on an underside of the dome for engaging the spaced apart electrical traces upon collapse of the dome, the first dome underlying the first end of the keycap and the second dome underlying the second end of the keycap, a nub set for the first audible lock arm comprising first and second spaced apart nubs formed in the housing and positioned to be selectively engaged by the first ridge, the keycap being movable from a first position wherein the first ridge is on an outer side of the first nub and the first end the the keycap is depressed to collapse the first dome, the keycap being movable to a second position wherein the first ridge is slid over the first nub producing in audible sound and wherein the first ridge comes to rest between the first and second nubs and wherein neither the first or second domes are collapsed, the keycap being movable to a third position wherein the first ridge is slid over the second nub to rest on an outer side of the second nub and so that the second end the keycap is depressed and the second dome is collapsed.

13. A switch as set forth in claim 12 wherein the keycap comprises an elongated body portion having two opposed sides, wherein the first arm extends downwardly from a first side of the body portion, and further comprising a second arm extending downwardly from a second side of the body portion.

14. A switch as set forth in claim 12 wherein the ridge and the nubs are wedge shaped.

15. A switch as set forth in claim 12 wherein the collapsible dome comprises an elastomeric material.

16. A switch as set forth in claim 15 wherein the elastomeric material comprises a silicone.

17. A switch as set forth in claim 12 wherein the spaced apart electrical traces are constructed and arrange to carry about 1 amp or less.

18. A switch comprising:

a keycap, a housing, a substrate, and a first collapsible dome;

the keycap being pivotally connected to the housing, the keycap having a body portion and two lock arms extending from the body portion, each lock arm having a first ridge, the substrate having at least a portion underlying the keycap and having at least a first pair of spaced apart electrical traces formed on a surface of the substrate, the first collapsible dome overlying the first pair of spaced apart electrical traces and having a conductive element on an underside of the dome positioned to engage the spaced apart electrical traces upon collapse of the first dome, a nub set for each lock arm comprising at least a first nub formed in the housing and positioned to selectively be engaged by the first ridge, the keycap being movable to a first position in which the body collapses the first dome and wherein the first ridge it is on the first side of the first nub locking the keycap in the first position, and the keycap being movable to a second position wherein the dome is fully extended and the first ridge is on a second side of the first nub locking the keycap in the second position.

19. A switch as set forth in claim 18 wherein each nub set further comprises a second nub, and wherein the keycap is movable from the second position to a third position wherein the ridge is on an outer side of the second nub.

* * * * *